US005228257A

United States Patent [19]

Bowersox et al.

[11] Patent Number: 5,228,257

[45] Date of Patent: Jul. 20, 1993

[54] MODULAR WALL SYSTEM

[75] Inventors: R. James Bowersox; Frank H. Mapstone; W. Thomas Plymale, all of Waynesboro; Rupert P. Chandler, Jr., Stuarts Draft, all of Va.

[73] Assignee: AWH Corporation, Waynesboro, Va.

[21] Appl. No.: 664,089

[22] Filed: Mar. 4, 1991

[51] Int. Cl.[5] ..... E04B 2/00

[52] U.S. Cl. ..... 52/588; 52/595; 52/592; 52/785; 52/803; 52/762; 52/763

[58] Field of Search ..... 52/595, 588, 481, 478, 52/763, 762, 732, 785, 802, 803, 309.9, 309.11, 578, 592; 49/DIG. 1

[56] References Cited

U.S. PATENT DOCUMENTS

| | | | |
|---|---|---|---|
| 780,332 | 1/1905 | Forshee . | |
| 2,047,154 | 7/1936 | Pimsner . | |
| 2,117,397 | 6/1937 | Bonsall . | |
| 2,148,858 | 2/1939 | Freeman et al. | 52/588 |
| 2,297,609 | 4/1940 | Clark . | |
| 2,644,552 | 7/1953 | MacDonald . | |
| 2,678,116 | 5/1954 | Gruber | 52/578 |
| 2,825,432 | 3/1958 | Parkes | 52/588 X |
| 2,912,725 | 11/1959 | Ries . | |
| 3,267,626 | 8/1966 | Daly | 52/588 X |
| 3,296,759 | 1/1967 | Pavlecka . | |
| 3,332,170 | 7/1967 | Bangs . | |
| 3,353,318 | 11/1967 | Bacher . | |
| 3,913,292 | 10/1975 | Braekkan | 52/592 X |
| 4,037,377 | 7/1977 | Howell et al. . | |
| 4,100,710 | 7/1978 | Kowallik | 52/595 X |
| 4,104,408 | 8/1978 | Heintz et al. | 52/595 X |
| 4,107,892 | 8/1978 | Bellem | 52/802 X |
| 4,110,948 | 9/1978 | Maier, Jr. . | |
| 4,316,351 | 2/1982 | Ting . | |
| 4,571,915 | 2/1986 | Barman . | |
| 4,677,798 | 7/1987 | Phillips . | |
| 4,731,964 | 3/1988 | Phillips . | |
| 4,744,185 | 5/1988 | Lamberet et al. . | |
| 4,928,468 | 5/1990 | Phillips . | |
| 4,936,078 | 6/1990 | Porter | 52/478 X |

*Primary Examiner*—Carl D. Friedman
*Assistant Examiner*—Robert J. Canfield
*Attorney, Agent, or Firm*—Howson and Howson

[57] ABSTRACT

In a metal wall comprising prefabricated modules joined together by double lap joints, an insulating strip, provided on each prefabricated module, is clamped between opposed transverse flanges which connect a laterally extending internal web of the joint to one of the faces of the module. The insulated strip extends from between the flanges into a space between the laterally extending internal webs of the joint, and thereby provides insulation between the opposite faces of the module, as well as between the module and its adjoining module. A screw fastener is used to secure the internal webs together, and a space between adjacent edges of faces of the adjoining modules is situated opposite the internal webs so that the fastener can be introduced through the space and concealed by a tamper-resistant caulking material introduced into the space.

14 Claims, 2 Drawing Sheets

MODULAR WALL SYSTEM

FIELD OF THE INVENTION

This invention relates generally to double lap wall panel modules suitable for use in enclosing or partitioning rooms. It relates more particularly to wall panel modules, prefabricated with acoustic isolation and thermal protection, and to wall panel modules having particular utility in prison cells and other installations in which a high degree of security is desired.

BACKGROUND OF THE INVENTION

Prefabricated panel modules are desirable for use in buildings and other kinds of construction because of their versatility and low cost. Modules are mass-produced in various standard sizes for engagement to adjacent modules of similar configuration. Typically, each module is fabricated of two parallel, spaced, rectangular metal face panels joined by laterally extending end structures along opposite edges. The prefabricated modules are typically connected in edge-to-edge relationship by seam welding.

The modules are especially suitable for constructing security walls and ceilings of cells in correctional facilities, where many of the cells are of repetitive design and construction. The modules are fabricated of steel and therefore inherently resistant to vandalism, fire, and destruction by inmates.

The usefulness of these modules, particularly in prison construction, is severely limited because the joints conduct heat across the modules, and also from one module to another. In addition, sound is easily transmitted through the joints, across the modules and from one module to another, reducing privacy and, in the case of prison cells, compromising security.

In one proposed alternative construction, the opposed face panels of a module are insulated from each other by means of a seal such as glass fiber rope compressed between mating elements of the face panels. This helps to reduce sound transmission and heat transfer between panels of a module. However, adjacent modules are secured together by welding in metal-to-metal contact. Thus no adequate provision is made for thermal or sound insulation between the adjacent modules. Furthermore, welding adjacent modules together on-site is labor intensive and consequently expensive.

In another proposed alternative construction, modules having ship-lap joints are used. Insulation strips are interposed between the joint elements of adjoining modules, and between the opposed face panels of each of the modules, to provide thermal and sound insulation between adjacent modules as well as to reduce heat and noise conduction across the wall. In the ship-lap joint, it has been generally thought necessary to install the insulating strips on-site. Until the present invention, there has been no satisfactory, structurally simple, way of providing factory-installed insulation strips in a ship-lap joint Another problem in ship-lap joints is that it is necessary in many cases to use a screw or similar fastener to secure adjoining modules together. Tamper-resistant screw heads, i.e. heads capable of being turned by a screwdriver in the tightening direction only, can be used, but are not entirely satisfactory in a prison environment.

SUMMARY OF THE INVENTION

Accordingly, it is an object of the present invention to provide a wall module suitable for construction of rooms and partitions which have improved resistance to heat and sound transmission, and which will allow for thermal expansion and contraction.

It is another object of the invention to provide a prefabricated wall module which does not require labor-intensive application of heat resistant and sound absorbing material at a construction site.

Still another object of the invention is to provide a structurally simple wall module, constructed of spatially separated panels, with simple and effective means to limit heat and sound conduction from one panel to the other and from one module to an adjacent module.

A further object of the invention is to provide a novel wall module with heat and sound inhibiting capabilities which can be readily and inexpensively prefabricated in standard sizes for assembly in various building configurations.

A still further object of the invention is to provide a wall module which is of relatively simple design for ease of shipping, handling, and erection at a building site.

Still a further object of the invention is to provide a novel and simple means of fastening adjoining wall modules together, which is highly resistant to tampering, and therefore highly effective for use in a prison environment.

Briefly, the wall module in accordance with the invention, is an improved prefabricated module having a double lap joint in which an insulating strip is clamped between a pair of parallel, closely spaced, flanges in planes which are in transverse relationship to the front and rear face panels of the module to provide insulation between the front and rear panels. The insulating strip extends, from between these two flanges of the double lap joint, over a face of a laterally extending internal web of the joint which comes into facing relationship with a corresponding laterally extending internal web of the mating joint of an adjoining module. Thus, the portion of the web which extends over the face of the laterally extending web provides insulation between the adjoining modules.

The double lap joint is preferably provided with a screw fastener arranged to secure the two facing webs of the joint of adjoining modules in fixed relationship to each other. Adjacent edges of faces of the adjoining modules are spaced from each other to provide a space which is filled with a tamper-resistant caulking material. The edges of these faces are related to the webs of the joint so that the caulk-filled space is opposed to the mutually facing, laterally extending, internal webs of the joint, and aligned with the axis of the screw fastener. The head of the screw fastener is recessed relative to the faces of the panels and hidden behind the tamper-resistant caulking material. Thus, the screw fastener can be introduced through the space between the edges of the face panels to fasten the internal webs together, and tamper-resistant caulking can thereafter be introduced into the space to preclude access to the fastener.

Further objects, advantages and details of the invention will be apparent from the following detailed description, when read in conjunction with the drawings.

DETAILED DESCRIPTION

Figure 1:
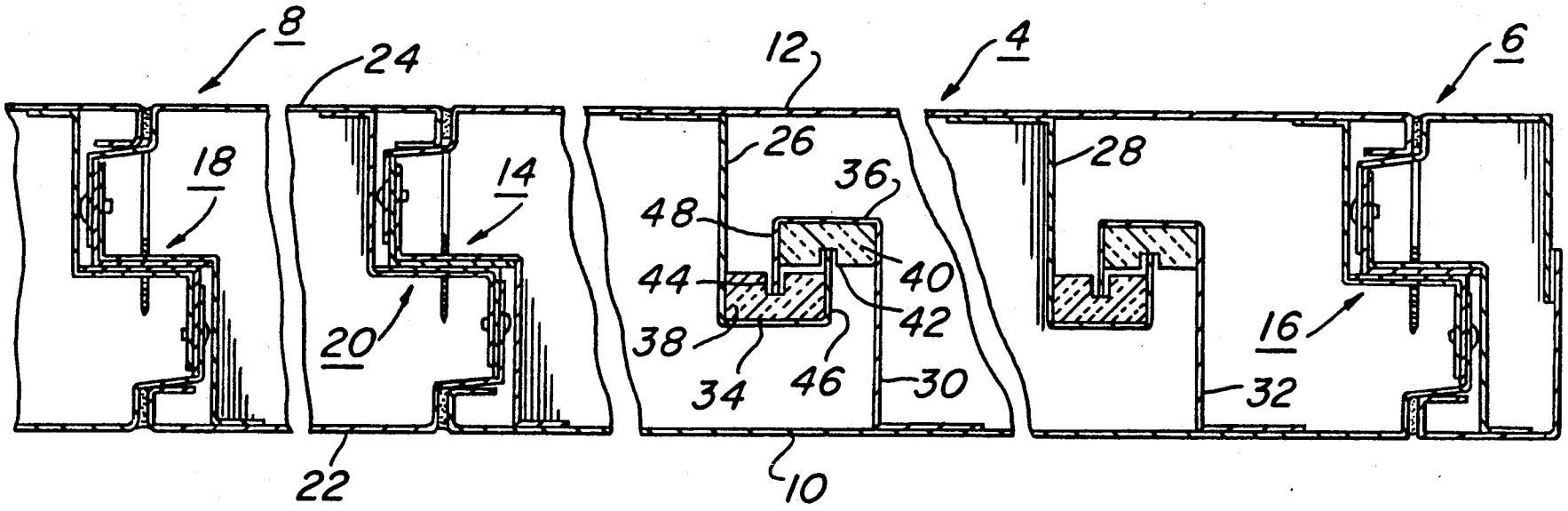
FIG. 1 is a fragmentary horizontal section through a wall comprising a pair of adjoining modules in accordance with the invention.

The wall of FIG. 1 comprises a wall module 4, secured along one of its vertical edges to an upright 6, and having a similar module 8 connected to its opposite vertical edge. The wall, of course, can include any number of additional modules similar to modules 4 and 8. The wall, which finds its principal utility in a prison facility, can be used as a partition between a prison cell and a common area, or as a party wall between adjacent cells.

Module 4, which is typical, comprises a front panel 10 and a rear panel 12, both formed of sheet metal, and fixed in opposed, spaced relationship to each other to provide parallel front and rear outer wall faces. The module has left and right end structures 14 and 16 respectively, connecting the front and rear panels. Module 8 has similar left and right end structures 18 and 20 connecting its front and rear panels 22 and 24.

Stiffeners 26 and 28 are welded to the interior face of rear panel 12 of module 4. Similar stiffeners 30 and 32 are welded to the interior face of front panel 10. Stiffeners 26 and 30 are formed with channels 34 and 36, which are in spaced, overlapping relationship. These channels interlock with each other to resist separation of the front and rear panels from each other in the event of buckling of the wall panels in a fire. The channels receive blocks 38 and 40 of suitable high density, substantially rigid, insulating material. The blocks are formed with vertically elongated channels 42 and 44, which receive the ends of flanges 46 and 48 respectively. The blocks provide a rigid connection between the front and rear panels which does not readily conduct heat and sound, and which prevents excessive vibration of the stiffeners. Similar blocks are provided between stiffeners 28 and 32. Any number of similar overlapping stiffeners can be provided within the module, and the number will, of course, depend on the horizontal dimensions of the module. A typical module is approximately four feet in length and six inches in thickness, and has two sets of overlapping stiffeners.

While stiffeners 28 and 30 are shown with two blocks, 38 and 40 respectively, in a modified version of the module, the two blocks can be integrated into a single block having two channels corresponding to channels 42 and 44.

The interior spaces within the module between the sets of stiffeners, and between the stiffeners and the end structures, can be filled with suitable insulation (not shown).

The wall, which is composed of several interconnected modules, is received in upper and lower channels (not shown), secured to structural elements of the building.

Figure 2:
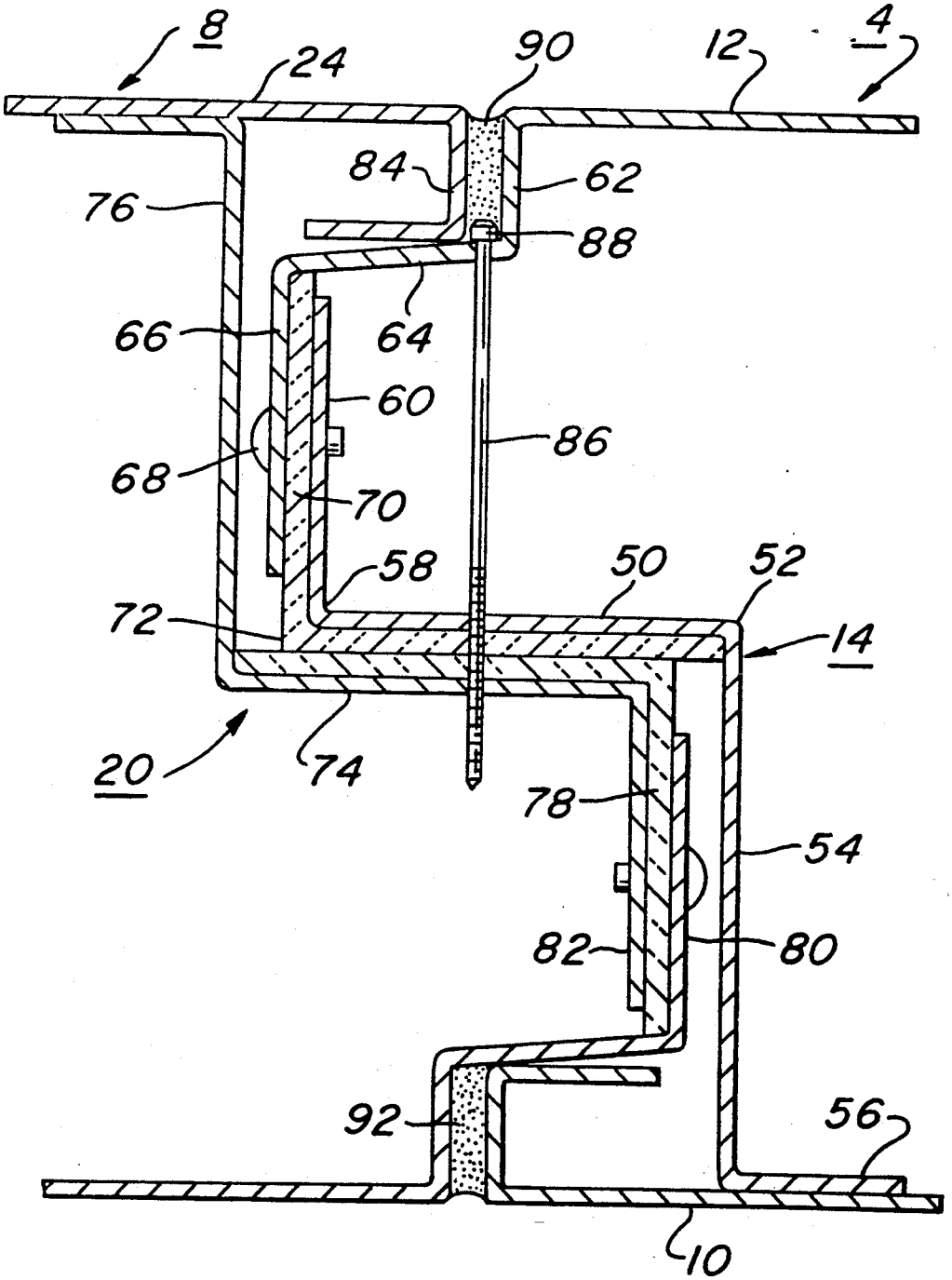
FIG. 2 is a fragmentary horizontal section illustrating the details of the double lap joint of the invention.

The interrelationship between the adjoining end structures of adjacent modules is shown in FIG. 2.

End structure 14 of module 4 has a stepped configuration, and comprises a formed sheet metal element having a web 50 which is situated at an intermediate location between panels 10 and 12 and preferably extends in substantially parallel relationship to the planes of the faces of the module. At inner edge 52 of web 50, i.e. the edge nearest the opposite end structure of module 4, the formed sheet metal element is bent to provide a connecting element 54. This connecting element extends toward the front wall in transverse relationship to the planes of the wall faces, and has a flange 56 welded to the inner surface of front panel 10. At the outer edge 58 of web 50, the formed sheet metal element is bent to provide a flange 60 which extends toward the rear face of the wall in transverse relationship to the planes of the wall faces. At the leftmost side edge of the rear face of module 4, panel 12 is bent inward to provide an element 62, which extends toward an intermediate location on web 50 between edges 52 and 58. Continuous with element 62 is a connecting element 64, which extends in transverse relationship to element 62 and terminates in an inwardly directed flange 66, which is in overlapping, spaced relationship to the outward face of flange 60.

Flanges 60 and 66 are secured together by a series of vertically spaced rivets, one of which is shown at 68. Between the flanges, there is clamped a strip 70 of glass fiber insulating tape. The rivets extend through holes (not shown) in the tape. The tape is bent at 72, and extends along the outer face of web 50 toward connecting element 54.

As seen in FIG. 2, end structure 20 of module 8 is similar to end structure 14, having a web 74 connected by connecting element 76 to rear panel 22, and a glass fiber insulating tape 78 clamped between flanges 80 and 82 and extending across the outer face of web 74.

The end structures 14 and 20 mate with each other as shown, with webs 50 and 74 in spaced, overlapping relationship and with two layers of glass fiber insulating tape between them. Flange 66 and its rivets are spaced from connecting element 76, and flange 80 and its rivets are similarly spaced from connecting element 54.

Rear panel 24 extends beyond connecting element 76, and has an inturned flange 84, which is in closely spaced relationship to inwardly extending element 62 of panel 12. A screw 86 extends through pre-drilled holes in element 64 and web 50, and through the two layers of glass fiber insulation between the webs, and is threaded into web 74. The head 88 of the screw bears against element 64, and is hidden behind a layer 90 of tamper-resistant caulking between elements 62 and 84. The tamper-resistant caulking can be an epoxy resin, for example. Several such screws, of course, can be provided, one above another. Tamper-resistant caulking is also provided on the front face of the wall at 92.

Screws similar to screw 86 can be installed in the opposite direction and threaded into web 50, if desired. Alternatively, provided that the upper and lower wall support structures are adequate and the modules are made of sufficiently heavy gauge metal, the screws can be eliminated altogether.

As will be readily apparent from FIG. 2, the modules can be factory assembled, with the insulating tapes clamped in place on the end structures. On site assembly then only requires positioning of the modules in mating relationship, as shown, installation of screws, if any, and caulking.

The glass fiber insulation strips provide thermal and sound insulation between the front and rear portions of the end structures of each module, and also provide thermal and sound insulation between adjacent modules. The spacings between flange 66 and element 76, and between flange 80 and element 54, are maintained by the screw fasteners, or by appropriate connections of the modules to top and/or bottom receiving structures (not shown). These spacings are also significant in minimizing heat and sound conduction between adjacent modules.

Clamping of the insulating strips between flanges which extend transverse to the front and rear faces prevents the rivets from interfering with the portions of the insulating strips situated between the webs. It also allows connecting elements 54 and 76 to be close to the panel edges, thereby strengthening the end structures.

The offset relationship between flange 66 and element 62, provided by element 64, positions the caulking space between elements 62 and 84 opposite intermediate, overlapping portions of webs 50 and 74. This allows screw 86 to be inserted through the space between elements 62 and 84, and positioned with its head hidden behind the tamper-resistant caulking 90. Consequently, there are no exposed fastener heads on the wall.

An advantage of the module construction described above is that both end structures of the modules, including the insulating tapes, are substantially identical, as are the front and rear panels. This makes the modules reversible, minimizes the number of parts which need to be kept in inventory at the factory, and otherwise simplifies factory assembly of the modules. Modules can be provided in several different horizontal lengths, using the same internal parts. The face panels for modules of different sizes are different from each other, but can be formed using the same dies without making any changes in the press brakes.

Modifications can be made to the modular wall system described above. For example, the connection provided between rear panel 12 and web 50 can be a continuous sheet of metal, and a pair of overlapping flanges, with an insulating strip clamped between them, can be substituted for connecting element 54. While webs 50 and 74 are desirably parallel to the wall faces, they can be obliquely disposed. The end structure elements can be formed in more complex shapes, including curved shapes. One of the insulating layers between the webs can be eliminated, if desired. Still other modifications can be made to the modular wall system described without departing from the scope of the invention as defined in the following claims.

We claim:

1. A building wall module comprising first and second sheet metal panels opposed to each other in parallel, spaced relationship, said module having a double lap joint structure connected to said first and second panels and adapted to mate with a similar joint structure of an adjoining module, said double lap joint structure comprising:

a sheet metal web, situated between said first and second panels, said web having a face adapted to come into facing, overlapping relationship with a corresponding web of the adjoining module, said web having a first edge and a second edge;

first means connecting said first edge of the sheet metal web to one of said panels; and second means connecting said second edge of the sheet metal web to the other of said panels;

in which one of said connecting means comprises:

a first sheet metal flange fixed to said web; and a second sheet metal flange fixed to the one of said panels connected to an edge of said web by said one of said connecting means; and in which said first and second flanges extend in overlapping relationship to each other; and further comprising:

means fastening said first and second flanges together in fixed relationship to each other; and insulating means comprising a sheet of insulating material situated in part between said first and second flanges, and extending, from between said first and second flanges, over at least a portion of said face of said sheet metal web, whereby said insulating means provides sound and heat insulation between said sheet metal web and a corresponding web of the adjoining module.

2. A building wall module according to claim 1 in which said web extends in substantially parallel relationship to said panels.

3. A building wall module according to claim 1 in which said first and second flanges extend in transverse relationship to said panels.

4. A building wall module according to claim 1 in which said first and second flanges extend in substantially perpendicular relationship to said panels.

5. A building wall comprising at least two modules, each of said two modules comprising a front face formed of sheet metal and a rear face also formed of sheet metal, the front and rear faces of each of said modules being fixed in spaced, parallel relationship to each other, with the front faces of both of said modules situated in a first common plane and the rear faces of both of said modules situated in a second common plane; in which each of said modules has first and second side structures spaced from and situated opposite each other, each side structure being connected to the front and rear faces of its module; in which one side structure of each of said two modules is in mating relationship with a side structure of the other of said modules; in which said one side structure of each module comprises:

a sheet metal web, situated between said common planes, and having an inner edge and an outer edge, the inner edge being nearer than the outer edge to the opposite side structure of the module;

first means connecting said inner edge of the sheet metal web to one of said front and rear faces of the module; and second means connecting said outer edge of the sheet metal web to the other of said front and rear faces of the module;

in which one of said connecting means comprises:

a first sheet metal flange fixed to said web and extending transverse to said common planes; and a second sheet metal flange fixed to the one of said front and rear faces of the module connected to an edge of said web by said one of said connecting means;

in which said first and second flanges extend in overlapping relationship to each other; and further comprising:

means fastening said first and second flanges together in fixed relationship to each other; and insulating means comprising a sheet of insulating material situated in part between said first and second flanges;

in which the sheet metal web of said one side structure of each module is disposed in overlapping, closely spaced relationship to the sheet metal web of said one side structure of the other module; and in which a portion of said sheet of insulating material for at least one of said mating side structures extends over at least part of the sheet metal web thereof and provides heat and sound insulation between the sheet metal webs of the mating side structures.

6. A building wall according to claim 5 in which a portion of said sheet of insulating material for each of said mating side structures extends over at least part of the sheet metal web thereof and overlaps the corresponding portion of the sheet of insulating material extending over the sheet metal web of the other of said mating side structures, whereby two overlapping layers of insulating material provide heat and sound insulation between the sheet metal webs of the mating side structures.

7. A building wall according to claim 5 including means rigidly securing said modules together with the first connecting means of each of the mating side structures opposed to, and spaced from, the second connecting means of the other of said mating side structures.

8. A building wall according to claim 5 comprising screw means extending through one of said sheet metal webs of the mating side structures and threaded into the other of said sheet metal webs.

9. A building wall according to claim 5 in which one of said front and rear faces of one of the modules has a side edge; and in which said second connecting means of said one side structure of said one of the modules comprises:

a first element extending from the outer edge of the sheet metal web of said one side structure in a direction transverse to said common planes and terminating in a first edge located between said common planes;

a second element extending inward from said side edge in a plane which intersects the overlapping webs of said mating side structures, said second element terminating in a second edge located between said common planes, said first and second elements being offset from each other; and connecting means rigidly connecting said first and second elements together, said connecting means comprising a connecting element extending from said second edge substantially to said first edge; and in which the face of the other module which is in a common plane with said one of said front and rear faces of said one of the modules has an inturned flange also extending in a plane which intersects said overlapping webs; in which said inturned flange and said second element are situated opposite to each other with a space between them; and having screw fastener means extending through said connecting element, and through said sheet metal webs, said screw fastener having a head bearing against said connecting element and a threaded shank threaded into the web of said other module.

10. A building wall according to claim 9 including tamper-resistant caulking material in said space, the head of said screw fastener being hidden by said caulking material.

11. A building wall comprising at least two modules, each of said two modules comprising a front face formed of sheet metal and a rear face also formed of sheet metal, the front and rear faces of each of said modules being fixed in spaced, parallel relationship to each other, with the front faces of both of said modules situated in a first common plane and the rear faces of both of said modules situated in a second common plane; in which each of said modules has first and second side structures spaced from and situated opposite each other, each side structure being connected to the front and rear faces of the module; in which one side structure of each of said two modules is in mating relationship with a side structure of the other of said modules; in which said one side structure of each module comprises:

a sheet metal web, situated between said common planes, and having an inner edge and an outer edge, the inner edge being nearer than the outer edge to the opposite side structure of the module;

first means connecting said inner edge of the sheet metal web to one of said front and rear faces of the module; and second means connecting said outer edge of the sheet metal web to the other of said front and rear faces of the module;

in which the sheet metal web of said one side structure of each module is disposed in overlapping relationship to the sheet metal web of said one side structure of the other module; in which one of said front and rear faces of one of the modules has a side edge; in which said second connecting means of said one side structure of said one of the modules comprises:

a first element extending from the outer edge of the sheet metal web of said one side structure in a direction transverse to said common planes and terminating in a first edge located between said common planes;

a second element extending inward from said side edge in a plane which intersects the overlapping webs of said mating side structures, said second element terminating in a second edge located between said common planes, said first and second elements being offset from each other; and connecting means rigidly connecting said first and second elements together, said connecting means comprising a connecting element extending from said second edge substantially to said first edge;

in which the face of the other module which is in a common plane with said one of said front and rear faces of said one of the modules has an inturned flange also extending in a plane which intersects said overlapping webs; in which said inturned flange and said second element are situated opposite to each other with a space between them; and having screw fastener means extending through said connecting element, and through said sheet metal webs, said screw fastener having a head bearing against said connecting element and a threaded shank threaded into the web of said other module.

12. A building wall according to claim 11 including tamper-resistant caulking material in said space, the head of said screw fastener being hidden by said caulking material.

13. A building wall according to claim 11 in which the sheet metal web of said one side structure of each module is disposed in closely spaced relationship to the sheet metal web of said one side structure of the other module; and further having insulating means comprising a sheet of insulating material situated at least in part between said sheet metal webs of the mating side structures and providing heat and sound insulation between said sheet metal webs.

14. A building wall comprising first and second modules, each of said modules comprising a front face formed of sheet metal and a rear face also formed of sheet metal, the front and rear faces of each of said modules being fixed in spaced, parallel relationship to each other, with the front faces of both of said modules situated in a first common plane and the rear faces of both of said modules situated in a second common plane; said modules having a joint comprising a first sheet metal web fixed to the first module and a second sheet metal web fixed to the second module and overlapping the first web, said webs being substantially parallel to said faces and forming an overlapping web structure situated between said common planes, said overlapping web structure having a first side facing toward said front face and an opposite side facing toward said rear face, and screw fastener means extending along an axis through said webs and securing the webs together; the faces of the modules in one of said common planes having adjacent edges which are parallel to each other with a space between them, said space being located on one side of said overlapping web structure; said axis along which the screw fastener means extends also extending through said space; and said screw fastener means having a head located on said one side of said overlapping web structure; and having tamper-resistant caulking means filling said space and precluding access to said head of the fastener means.

* * * * *